US009548150B2

(12) United States Patent
Zhou et al.

(10) Patent No.: US 9,548,150 B2
(45) Date of Patent: Jan. 17, 2017

(54) CERIUM-IRON-BASED MAGNETIC COMPOUNDS

(71) Applicant: GM GLOBAL TECHNOLOGY OPERATIONS LLC, Detroit, MI (US)

(72) Inventors: Chen Zhou, Warren, MI (US); Frederick E. Pinkerton, Shelby Township, MI (US); Jan F. Herbst, Grosse Pointe Woods, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 165 days.

(21) Appl. No.: 13/786,807

(22) Filed: Mar. 6, 2013

(65) Prior Publication Data

US 2014/0251500 A1 Sep. 11, 2014

(51) Int. Cl.

| | |
|---|---|
| ***H01F 1/057*** | (2006.01) |
| ***H01F 1/058*** | (2006.01) |
| ***H01F 1/059*** | (2006.01) |
| ***H01F 1/055*** | (2006.01) |

(52) U.S. Cl.

CPC ..... *H01F 1/0593* (2013.01)

(58) Field of Classification Search

CPC ..... H01F 1/057; H01F 1/055; H01F 1/058; H01F 1/05923

USPC ..... 148/221, 230, 301, 302, 306, 307, 310,148/311, 300, 315, 317, 331; 420/416, 128, 83, 420/121, 117

See application file for complete search history.

(56) References Cited

U.S. PATENT DOCUMENTS

| | | | | |
|---|---|---|---|---|
| 4,496,395 | A * | 1/1985 | Croat | C22C 45/00 148/301 |
| 5,800,728 | A * | 9/1998 | Iwata | 252/62.53 |
| 2006/0005898 | A1* | 1/2006 | Liu et al. | 148/105 |
| 2011/0227424 | A1* | 9/2011 | Yoshida et al. | 310/15 |
| 2012/0121904 | A1* | 5/2012 | Serre et al. | 428/402 |

OTHER PUBLICATIONS

V. Lachevre, B. Barbara, D. Fruchart, L. Pontonnier A new type of soft ferromagnetic alloys: RFe12—xGex Journal of Alloys and Compounds vol. 275-277, 24, Jul. 1998, pp. 615-619.*

Y. Y Z. Wang and G. C. Hadjipanayis Effect of nitrogen on the structural and magnetic properties of intermetallic compounds with the ThMn12 structure Journal of Applied Physics vol. 70, No. 10 15, Nov. 1991.*

Shunji Suzuki, Naomi noue, and Toshihiko Miura Mangetic Properties of RFe11—xCoxTiNy (R: Nd, Pr) compounds with ThMn12 Type structure IEEE Transations on magnetic, vol. 28, No. 5, Sep. 1992.*

K. G. Efthimiadis, S.C. Chadjivasiliou, A.K. Sianou, I.A. Tsoukalas, G. Kitsardakis, H. Bremers, J. Hesse Structural investigations of NdFe12—x—yTixNby alloys Journal of Magnetism and Magnetic Materials 242-245 (2002) 1381-1383.*

K. Ohashi, Y. Tawara, R. Osugi, and M. Shimao Magnetic properties of Fe-rich rare-earth intermetallic compounds with a ThMn12 structure J. Appl. Phys. 64 (10), Nov. 15, 1988 pp. 5714-5716.*

S. Obbadea , b ,*, D. Fruchartb, M. Bououdinab, S. Miragliab, J.L. Soubeyrouxb, O. Isnardb About hydrogen insertion in ThMn12 type alloys Journal of Alloys and Compounds 253-254 (1997) 298-301.*

* cited by examiner

*Primary Examiner* — Jessee Roe
*Assistant Examiner* — Jenny Wu
(74) *Attorney, Agent, or Firm* — Reising Ethington P.C.

(57) ABSTRACT

New magnetic materials containing cerium, iron, and small additions of a third element are disclosed. These materials comprise compounds $Ce(Fe_{12-x}M_x)$ where x=1-4, having the $ThMn_{12}$ tetragonal crystal structure (space group I4/mmm, #139). Compounds with M=B, Al, Si, P, S, Sc, Co, Ni, Zn, Ga, Ge, Zr, Nb, Hf, Ta, and W are identified theoretically, and one class of compounds based on M=Si has been synthesized. The Si cognates are characterized by large magnetic moments ($4\pi M_s$ greater than 1.27 Tesla) and high Curie temperatures ($264 \leq T_c \leq 305°$ C.). The $Ce(Fe_{12-x}M_x)$ compound may contain one or more of Ti, V, Cr, and Mo in combination with an M element. Further enhancement in $T_c$ is obtained by nitriding the Ce compounds through heat treatment in $N_2$ gas while retaining the $ThMn_{12}$ tetragonal crystal structure; for example $CeFe_{10}Si_2N_{1.29}$ has $T_c$=426° C.

8 Claims, 5 Drawing Sheets

CERIUM-IRON-BASED MAGNETIC COMPOUNDS

This invention was made with U.S. Government support under Agreement No. DE-AR0000195 awarded by the Department of Energy. The U.S. Government may have certain rights in this invention.

TECHNICAL FIELD

This invention provides new magnetic materials containing cerium, iron, and small additions of a third element(s), and comprising compounds $Ce(Fe_{12-x}M_x)$ having the $ThMn_{12}$ tetragonal crystal structure (space group I4/mmm, #139). Compounds with M=B, Al, Si, P, S, Sc, Ti, V, Co, Ni, Zn, Ga, Ge, Zr, Nb, Mo, Hf, Ta, and W are identified theoretically, and one class of compounds based on M=Si has been synthesized. The Si cognates are characterized by large magnetic moments $4\pi M_s$ (above 1.27 Tesla) and high Curie temperatures ($264 \leq T_c \leq 305°$ C.). Further enhancement in $T_c$ and magnetic moment is obtained by nitriding the cerium compounds through heat treatment in nitrogen gas while retaining the $ThMn_{12}$ crystal structure; for example $CeFe_{10}Si_2N_{1.29}$ has $T_c$=426° C.

BACKGROUND OF THE INVENTION

There remains a need for permanent magnet materials in electric motors for many applications and in other magnet-containing articles of manufacture. Cerium-iron compounds are attractive candidates to explore as potential permanent magnet materials. However, they have a low Curie temperature which will impede their use in major automotive applications (e.g., traction motors) because they will not retain sufficient magnetic properties in a device at elevated operating temperatures. It appears that if cerium-iron materials are to be thus utilized their compositions will have to be modified.

SUMMARY OF THE INVENTION

This invention provides a new series of Ce—Fe-based permanent magnet materials based on the presence in the material of a major portion of one or more compounds of the form $Ce(Fe_{12-x}M_x)$, where M is one or more elements selected from the group consisting of B, Al, Si, P, S, Sc, Co, Ni, Zn, Ga, Ge, Zr, Nb, Hf, Ta, and W. The material is prepared with the $Ce(Fe_{12-x}M_x)$ compound(s) in the form of a stable $ThMn_{12}$ tetragonal crystal structure (sometimes referred to as 1-12) to provide the permanent magnet properties. Preferably the value of x is in the range of 1-4. Compounds containing an M element from the above listing may additionally include one or more of Ti, V, Cr, and/or Mo along with one or more of the M-constituents. In general, it is preferred that the Ce—Fe-M magnetic materials be prepared by a suitable process, such as by rapid solidification from a melt of the constituent elements, to achieve the presence of a major phase of $Ce(Fe_{12-x}M_x)$ in the $ThMn_{12}$ tetragonal crystal structure and with x in the range of 1-4.

The above listed elements, M, forming a stable $ThMn_{12}$-type crystal structure with cerium and iron are identified in this specification using first-principles theoretical calculations based on Density Functional Theory (DFT) using the representative compound, $CeFe_8M_4$. In addition to the DFT calculations, examples of stable $ThMn_{12}$-type compounds have been synthesized with M=Si having stoichiometries $CeFe_{12-x}Si_x$ (x=1, 1.5, and 2).

Permanent magnet alloys containing $CeFe_{11}Si$, $CeFe_{10.5}Si_{1.5}$, and $CeFe_{10}Si_2$ were prepared by combining stoichiometric quantities of elemental Ce, Fe, and Si in an ingot. Ingots of these materials were then melted under inert gas and subjected to a rapid solidification process to form ribbon particles. The ribbon particles were comminuted to a powder and magnetically characterized. The magnetic moment (saturation magnetization) $4\pi M_s$ may be approximated by the value of the magnetization $4\pi M$ at the largest applied magnetic field (H) of 1.9 Tesla; given that the magnetization is still slowly increasing with H at 1.9 Tesla, the values of $4\pi M_s$ presented in this application thus represent lower limits to the actual saturation magnetization. The three $CeFe_{12-x}Si_x$ alloys were found to have large magnetic moments $4\pi M_s$=1.04 to 1.27 Tesla and Curie temperatures, 264° C.<$T_c$<305° C., which are higher than the Curie temperatures of any previously known Ce—Fe-based compounds. Curie temperatures are further improved by heat treatment under nitrogen gas to form the corresponding $CeFe_{12-x}M_xN_y$ nitrides, while retaining the $ThMn_{12}$ crystal structure. The nitride $CeFe_{10}Si_2N_{1.29}$ boasts a Curie temperature of 426° C. and a higher magnetic moment than its precursor, $CeFe_{10}Si_2$.

Accordingly, we have prepared specific $CeFe_{12-x}Si_x$ compositions where x=1, 1.5, and 2, and demonstrated that they possess useful permanent magnetic properties. And we have determined that a family of compositionally related compounds is likely to be formable in a like manner into useful permanent magnet materials. These related compounds are $Ce(Fe_{12-x}M_x)$, where M is one or more elements selected from the group consisting of B, Al, Si, P, S, Sc, Co, Ni, Zn, Ga, Ge, Zr, Nb, Hf, Ta, or W. In these compounds it is preferred that x have a value in the range of one to four. Proportions of one or more of Ti, V, Cr, and Mo may be combined with or substituted for up to about ninety percent of one of the M elements in our Ce—Fe-M magnetic material; for example, $CeFe_{10.25}Si_{1.5}Ti_{0.25}$.

The magnetic material may be prepared in powder form for compacting, molding, resin bonding, or other shaping practice into a useful permanent magnet body for use in an electric motor or other magnet application. Other objects and advantages of our invention will be apparent from the following sections of this specification.

BRIEF DESCRIPTION OF THE DRAWINGS

In FIG. 5(*a*) values of the lattice constant a in Angstroms (filled diamonds) are presented on the left-side vertical axis and values of the lattice constant c (filled squares) are presented on the right vertical axis. Data at 0 hour nitriding time represent values for un-nitrided base alloy. In FIG. 5(*b*), lattice volumes in cubic Angstroms are presented on the left vertical axis and volume expansions in (%) are presented on the right vertical axis.

DESCRIPTION OF PREFERRED EMBODIMENTS

Figure 1:
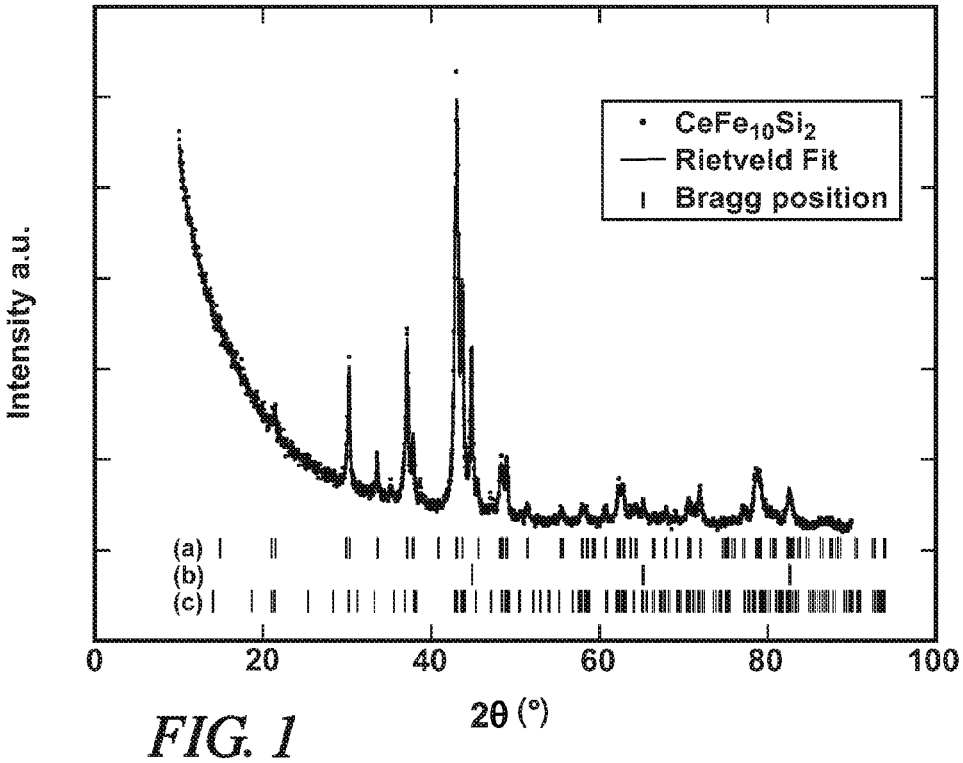
FIG. 1 illustrates a Rietveld analysis fit of an X-ray diffraction pattern on a sample of $CeFe_{10}Si_2$ melt spun at 15 m/s based on the three most probable phases: the hypothetical $ThMn_{12}$-type $CeFe_{10}Si_2$ crystal phase, the $Fe_{0.95}Si_{0.05}$ phase, and the $Ce_2Fe_{14}Si_3$ phase. The unfitted three minor peaks at 34.9, 38.7, and 46.8 degrees 2Θ belong to $SiO_2$. The short vertical lines (|) of row (a) mark the Bragg positions for $CeFe_{10}Si_2$, row (b) for $Fe_{0.95}Si_{0.05}$, and row (c) for $Ce_2Fe_{14}Si_3$.

First principles Density Functional Theory (DFT) was applied in order to computationally identify elements M for which $CeFe_{12-x}M_x$ compounds having the prototypical tetragonal $ThMn_{12}$-type crystal structure may form. In that structure the Th ions occupy 2a crystallographic sites; the Mn ions reside on 8i, 8j, and 8f sites. Neutron diffraction studies of known $RFe_{12-x}M_x$ materials (R=rare earth) demonstrate that the M ions show distinct site preferences among the 8i, 8j, and 8f sites. Within the preferred crystallographic site, however, the Fe and M ions are disordered. Treating the intra-site disorder on such high occupancy sites is a daunting computational challenge. Instead, elements M that might stabilize the $ThMn_{12}$ structure are qualitatively identified via a much more tractable approach: element M is assumed to fully occupy the 8i, 8j, or 8f sites in the $ThMn_{12}$ structure, corresponding to the stoichiometry, $CeFe_8M_4$, and the enthalpy of formation, ΔH, is computed for each of the three cases. A negative ΔH suggests the formation of $CeFe_{12-x}M_x$.

All calculations reported here rely on DFT as implemented in the Vienna ab initio simulation package (VASP) within a plane wave basis set. Potentials constructed by the projector-augmented wave (PAW) method were employed for the elements; the generalized gradient approximation was used for the exchange-correlation energy functional. As a consequence of 4f shell instability, the cerium ion in intermetallic compounds is often in a mixed-valent, α-like state that is incompatible with a local 4f magnetic moment. In view of the fact that only 3+ (one 4f electron in a frozen core) and 4+ (one 4f electron treated variationally with two 5s, six 5p, and three 5d-6s electrons) PAW potentials are available in VASP, the latter was chosen as the preferable approximation for the materials studied. Lattice constants and atomic positions were optimized by simultaneously minimizing all atomic forces and stress tensor components via a conjugate gradient method. Dense reciprocal space meshes having spacings <0.10 $Å^{-1}$ were used throughout. In all computations the plane wave cutoff energy was 900 eV, the total energy was converged to $10^{-6}$ eV per cell, and the force components relaxed to at least $10^{-4}$ eV/Å. No fewer than three successive full-cell optimizations were conducted to ensure that the structural parameters and cell energies were fully converged. Total energies were derived by integration over the irreducible Brillouin zone with the linear tetrahedron method.

The electronic total energies $E_{el}$ obtained with VASP enable calculation of $\Delta H_{el}(CeFe_8M_4)$, the standard enthalpy of $CeFe_8M_4$ formation at zero temperature in the absence of zero point energy contributions:

$$\Delta H_{el}(CeFe_8M_4) \equiv E_{el}(CeFe_8M_4) - E_{el}(Ce) - 8E_{el}(Fe) - 4E_{el}(M) \quad (1).$$

In the case of the progenitor compound $CeFe_{12}$ this yields $$\Delta H_{el}(CeFe_{12}) = E_{el}(CeFe_{12}) - E_{el}(Ce) - 12E_{el}(Fe) = 11 \text{ kJ/mole } CeFe_{12} \quad (2);$$

the positive value is consistent with the experimental observation that $CeFe_{12}$ does not form under normal conditions.

Table I presents $\Delta H_{el}$, the magnetic moment μ, and cell volume V calculated for $CeFe_8M_4$ with M one of 26 elements other than Fe populating the 8i, 8j, or 8f sites in the $ThMn_{12}$ structure. The bold-data cells highlight the cases for which $\Delta H_{el}$ is the most negative, indicating the greatest stability with respect to the elemental constituents, for a given M and lattice position.

The results suggest that $CeFe_{12-x}M_x$ may be stabilized by M=B, Al, Si, P, S, Sc, Ti, V, Co, Ni, Zn, Ga, Ge, Zr, Nb, Mo, Hf, Ta, and W with Sc, Ti, V, Zr, Nb, Mo, Hf, Ta, W preferring the 8i site and B, Al, Si, P, S, Co, Ni, Zn, Ga, Ge preferring the 8j site. C, Na, Mg, Mn, Cu, and Sn are definitely not favorable in view of the large, positive $\Delta H_{el}$ values. The small but positive $\Delta H_{el}$ for $CeFe_8Cr_4$ (Cr filling the 8i site) is consistent with the fact that $RFe_{12-x}Cr_x$ compounds are known only for x≤2.

The findings are in qualitative overall agreement with experiment inasmuch as (i) $CeFe_{12-x}M_x$ (M=Ti, V, Cr, Mo) compounds have been reported previously and (ii) $CeFe_{12-x}Si_x$ (x=1.0, 1.5, 2.0) has been synthesized as part of this work. Table I indicates that $CeFe_{12-x}M_x$ (M=B, Al, P, S, Sc, Co, Ni, Zn, Ga, Ge, Zr, Nb, Hf, Ta, and W) merit attempts to synthesize as well. The Sc material, even if it were to form, is not interesting from a technological perspective in view of the scarcity and associated enormous cost of Sc. The M=Co, Ni, Zn, Ga, and Ge compounds, on the other hand, may be particularly interesting since their magnetic moments per formula unit in Table I are about twice those of the M=Ti, V, Cr, and Mo compounds, which would afford magnets with substantially greater energy products and likely larger Curie temperatures. The relatively large cell volume of $CeFe_8Zr_4$ may foreshadow the formation of trivalent Ce, which would have a 4f magnetic moment that would contribute to the overall magnetization and provide magnetocrystalline anisotropy.

TABLE I

Density functional theory calculation results for $CeFe_8M_4$ compounds.

| | M in 8i site | | | M in 8j site | | | M in 8f site | | |
|---|---|---|---|---|---|---|---|---|---|
| | $\Delta H_{el}$ (kJ/mole f.u.) | μ $\mu_B$/ f.u.) | V (Å$^3$/ f.u.) | $\Delta H_{el}$ (kJ/mole f.u.) | μ $\mu_B$/ f.u.) | V (Å$^3$/ f.u.) | $\Delta H_{el}$ (kJ/mole f.u.) | μ ($\mu_B$/ f.u.) | V (Å$^3$/ f.u.) |
| $CeFe_8B_4$ | 213 | 12.2 | 144.7 | −151 | 10.5 | 140.7 | −106 | 12.0 | 131.7 |
| $CeFe_8C_4$ | 429 | 13.7 | 142.5 | 525 | 7.8 | 135.9 | 767 | 11.6 | 128.1 |
| $CeFe_8Na_4$ | 637 | 18.3 | 212.4 | 945 | 17.4 | 231.8 | 929 | 19.3 | 240.6 |
| $CeFe_8Mg_4$ | 145 | 16.3 | 196.0 | 293 | 16.3 | 197.3 | 417 | 16.6 | 199.5 |
| $CeFe_8Al_4$ | −268 | 14.1 | 178.3 | −300 | 14.5 | 178.9 | −192 | 14.6 | 177.9 |
| $CeFe_8Si_4$ | −324 | 12.6 | 167.5 | −479 | 13.2 | 168.4 | −409 | 11.8 | 161.6 |
| $CeFe_8P_4$ | −355 | 15.2 | 179.9 | −555 | 12.4 | 165.2 | −358 | 14.0 | 158.6 |
| $CeFe_8S_4$ | −169 | 22.1 | 190.1 | −266 | 18.4 | 174.8 | −11 | 17.6 | 173.6 |
| $CeFe_8Sc_4$ | −52 | 10.6 | 198.7 | 127 | 12.6 | 206.8 | 272 | 13.7 | 214.6 |
| $CeFe_8Ti_4$ | −253 | 7.9 | 179.0 | −138 | 10.3 | 185.2 | 42 | 9.9 | 186.6 |
| $CeFe_8V_4$ | −149 | 8.2 | 168.3 | −64 | 8.7 | 172.3 | 27 | 9.8 | 173.6 |
| $CeFe_8Cr_4$ | 3 | 8.8 | 161.7 | 91 | 6.0 | 165.8 | 109 | 12.7 | 166.2 |
| $CeFe_8Mn_4$ | 14 | 4.4 | 161.2 | 112 | 18.9 | 162.2 | 67 | 16.6 | 162.4 |
| $CeFe_8Co_4$ | −1 | 22.8 | 165.67 | −63 | 23.1 | 165.72 | −58 | 24.6 | 166.9 |
| $CeFe_8Ni_4$ | −28 | 18.3 | 165.46 | −103 | 20.0 | 165.46 | −76 | 21.8 | 167.3 |
| $CeFe_8Cu_4$ | 103 | 16.2 | 169.9 | 76 | 16.7 | 169.4 | 145 | 18.5 | 171.2 |
| $CeFe_8Zn_4$ | 5 | 15.9 | 178.7 | −35 | 15.9 | 177.7 | 49 | 16.8 | 177.6 |
| $CeFe_8Ga_4$ | −185 | 15.4 | 180.9 | −240 | 16.3 | 181.9 | −123 | 15.8 | 179.3 |
| $CeFe_8Ge_4$ | −148 | 15.7 | 181.0 | −268 | 15.4 | 181.9 | −92 | 15.9 | 15.9 |
| $CeFe_8Zr_4$ | −78 | 10.6 | 202.8 | 98 | 11.7 | 213.0 | 271 | 11.3 | 219.1 |
| $CeFe_8Nb_4$ | −71 | 9.7 | 187.2 | 84 | 10.6 | 195.0 | 290 | 12.2 | 202.0 |
| $CeFe_8Mo_4$ | −13 | 9.1 | 178.0 | 168 | 8.7 | 183.0 | 255 | 14.9 | 191.7 |
| $CeFe_8Sn_4$ | 37 | 17.9 | 210.8 | 31 | 17.6 | 213.5 | 251 | 18.3 | 218.1 |
| $CeFe_8Hf_4$ | −150 | 9.9 | 198.9 | 3 | 11.6 | 208.3 | 194 | 11.0 | 212.5 |
| $CeFe_8Ta_4$ | −148 | 8.9 | 187.4 | 3 | 10.4 | 193.7 | 220 | 10.6 | 199.9 |
| $CeFe_8W_4$ | −17 | 8.8 | 178.7 | 153 | 8.3 | 183.3 | 268 | 13.9 | 192.7 |

Alloys of $CeFe_{11}Si$, $CeFe_{10.5}Si_{1.5}$, and $CeFe_{10}Si_2$ were prepared by combining stoichiometric quantities of elemental Ce, Fe, and Si. Ingots were prepared by induction melting the elements under argon inert gas at 1420-1450° C., holding the molten alloy at that temperature for 3-5 minutes to ensure complete homogenization by induction stirring. Pieces of the resulting homogenized ingot were placed in a quartz ampule having a 0.65±0.01 mm diameter orifice in the bottom, remelted by induction heating to 1420-1450° C., and melt-spun by applying a 2.5-3.5 psi overpressure to eject the molten alloy onto the circumference of a rapidly rotating chromium-plated copper wheel (diameter D=25.4 cm). The surface speed, $v_s$, of the wheel was varied between 5 and 40 m/s to alter the quench conditions. The resulting ribbon materials were collected, ball milled into powder, and their properties examined by X-ray diffraction (XRD) to determine crystal structure and phase composition. Table II summarizes the compositions, wheel speeds, and selected results.

TABLE II

Summary of $CeFe_{12-x}Si_x$ materials

| Nominal composition | Wheel speed $v_s$ (m/s) | Lattice constants* a (Å) | Lattice constants* c (Å) | Magnetic moment $4\pi M_s$ (Tesla)* | $T_c$ (° C.)* |
|---|---|---|---|---|---|
| $CeFe_{11}Si$ | 5, 10, 15, 20, 25, 30 | 8.410 | 4.889 | 1.27 | 264 |
| $CeFe_{10.5}Si_{1.5}$ | 5, 10, 15, 20, 25, 30, 35, 40 | 8.405 | 4.841 | 1.20 | 293 |
| $CeFe_{10}Si_2$ | 5, 7.5, 10, 12.5, 15, 20, 25, 30, 35 | 8.420 | 4.802 | 1.04 | 305 |

*Values for ribbons melt-spun at 15 m/s

Figure 2:
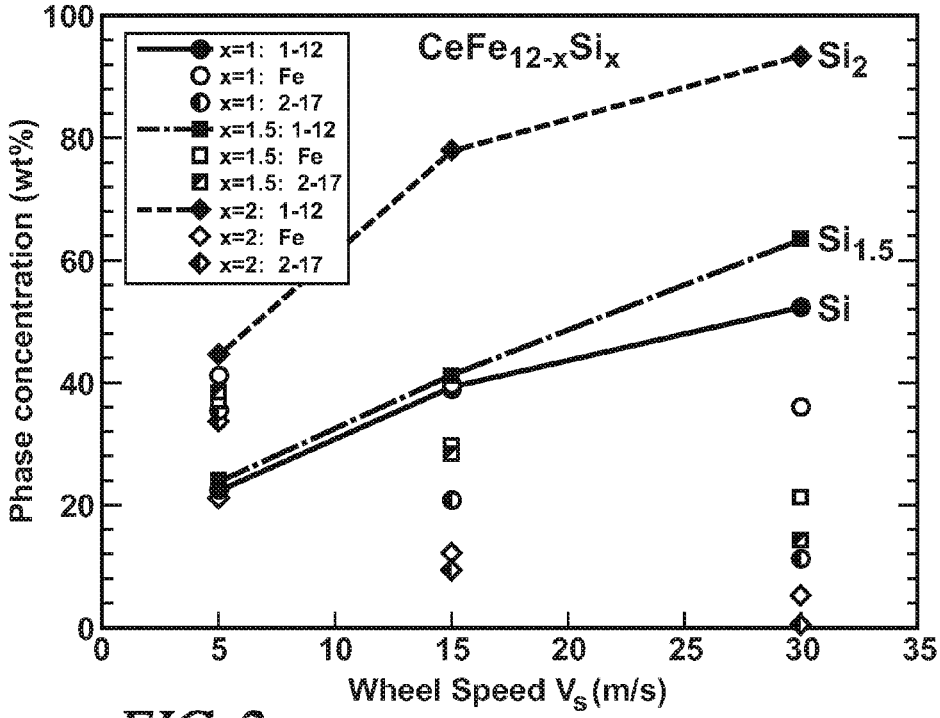
FIG. 2 is a graph of phase concentration (wt %) for $CeFe_{12-x}Si_x$ (x=1, 1.5, 2) alloys melt spun at 5 m/s, 15 m/s, and 30 m/s, respectively. The designation 1-12 in the legend represents the $ThMn_{12}$ crystal structure, Fe represents Fe—Si compound, and 2-17 refers to $Ce_2Fe_{17-y}Si_y$.
Figure 3:
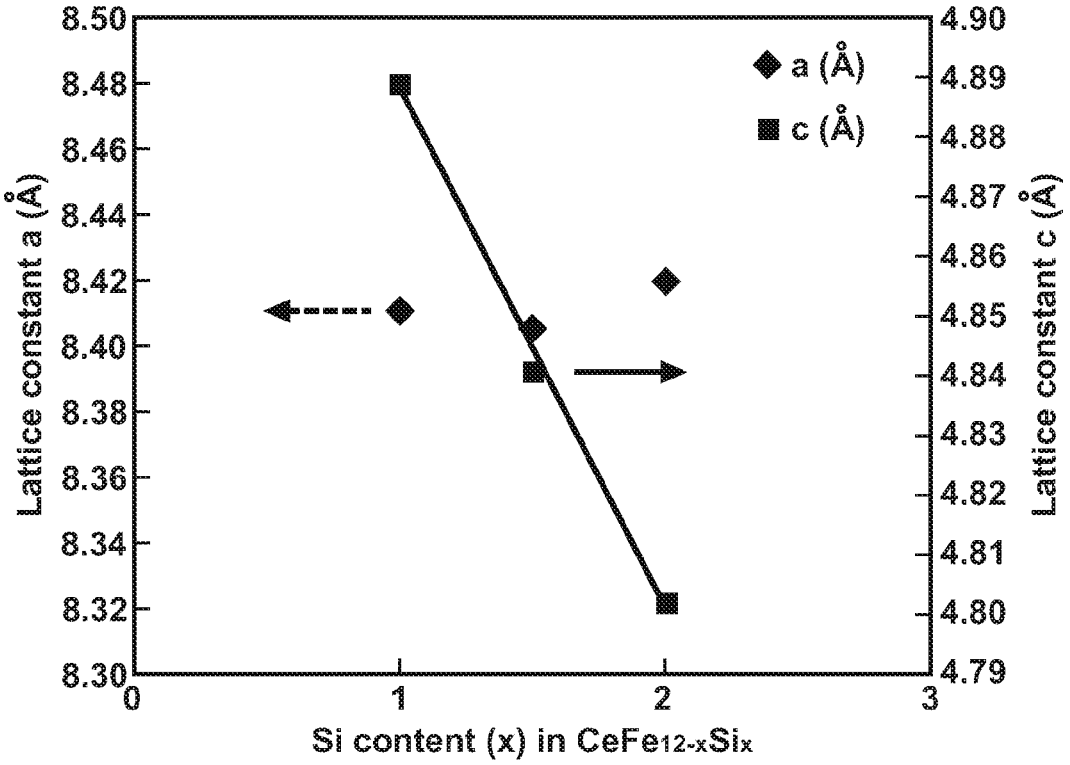
FIG. 3 is a graph of lattice constants in Angstrom units (Å) as a function of silicon (Si) content in $CeFe_{12-x}Si_x$ for x=1, 1.5, and 2. The values of lattice constants in Å on the left-side vertical axis are for a (filled diamonds) and the lattice constants in Å on the right vertical axis are for c (filled squares).
Figure 4:
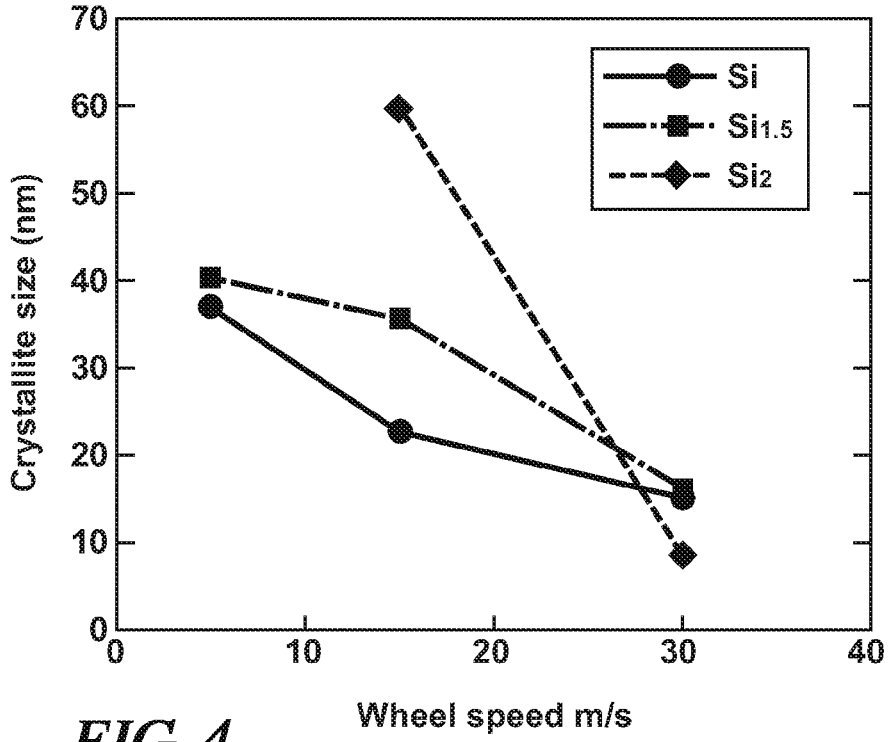
FIG. 4 is a graph of crystallite size in nanometers (nm) as a function of melt-spin wheel speed in m/s for selected $CeFe_{12-x}Si_x$ alloys.

Rietveld analysis was applied to the XRD patterns from $CeFe_{11}Si$, $CeFe_{10.5}Si_{1.5}$, and $CeFe_{10}Si_2$ ribbons melt-spun at various wheel speeds. An example is shown in FIG. 1 for $CeFe_{10}Si_2$ ribbons melt-spun at 15 m/s. The Rietveld fit demonstrates that the major phase (more than 78 wt % of the sample) has the $ThMn_{12}$-type tetragonal crystal structure, with the balance being $Fe_{0.95}Si_{0.05}$ and $Ce_2Fe_{14}Si_3$ (hexagonal $Ce_2Fe_{17}$ with partial substitution of Si for Fe). Similar good fits were obtained for other samples. FIG. 2 exhibits the phase fraction in weight percentage for $CeFe_{12-x}Si_x$ alloys melt spun at 5 m/s, 15 m/s, and 30 m/s respectively. For a fixed wheel speed $v_s$, the fraction of $CeFe_{12-x}Si_x$ phase increases with increasing x. For a fixed composition, a higher wheel speed favors the formation of $CeFe_{12-x}Si_x$ phase. FIG. 3 shows the lattice constants a and c of the tetragonal crystal structure as a function of Si content x in $CeFe_{12-x}Si_x$. The a axis is almost independent of the Si content, while the c axis contracts linearly with increasing Si content. FIG. 4 shows the crystallite size as a function of wheel speed from the Rietveld full profile fitting; as expected for rapidly quenched materials, the grain size is less than 70 nm and decreases with increasing wheel speed (increasing quench rate).

Curie temperatures $T_c$ were measured for each $CeFe_{12-x}Si_x$ alloy melt spun at 15 m/s, and the results are given in Table II. Values of $T_c$ were obtained by monitoring the temperature dependence of the magnetic force in a small applied magnetic field using a Perkin-Elmer System 7 thermogravimetric analyzer (TGA). The Curie temperature is taken as the point where the contribution to the magnetic force (i.e., the magnetization) due to $CeFe_{12-x}Si_x$ vanishes. The Curie temperatures are the highest observed in Ce—Fe-based compounds to date. Notably, $T_c$ increases with Si content even though the Fe content of the $Ce(Fe_{12-x}M_x)$ compound is reduced.

Nitriding of selected $Ce(Fe_{12-x}M_x)$ ribbons with pure nitrogen gas was performed in a Hiden Isochema Intelligent Gravimetric Analyzer (IGA). The typical nitriding profile is set as the following: temperature (T) 450-500° C., time (t) 1-48 hours, and pressure (P) 20 bar of nitrogen gas. The powders were sieved to 25-45 μm sized particles prior to nitriding. The nitrogen uptake was calculated from the change in sample weight at approximately 1 bar and room temperature (20° C.), before and after nitrogenation, in order to eliminate the confounding effect of buoyant forces at elevated pressure and temperature. Typically $Ce(Fe_{12-x}M_x)$ compounds can absorb one to three nitrogen atoms per formula unit after being fully saturated by the nitrogenation process.

Figure 5A:
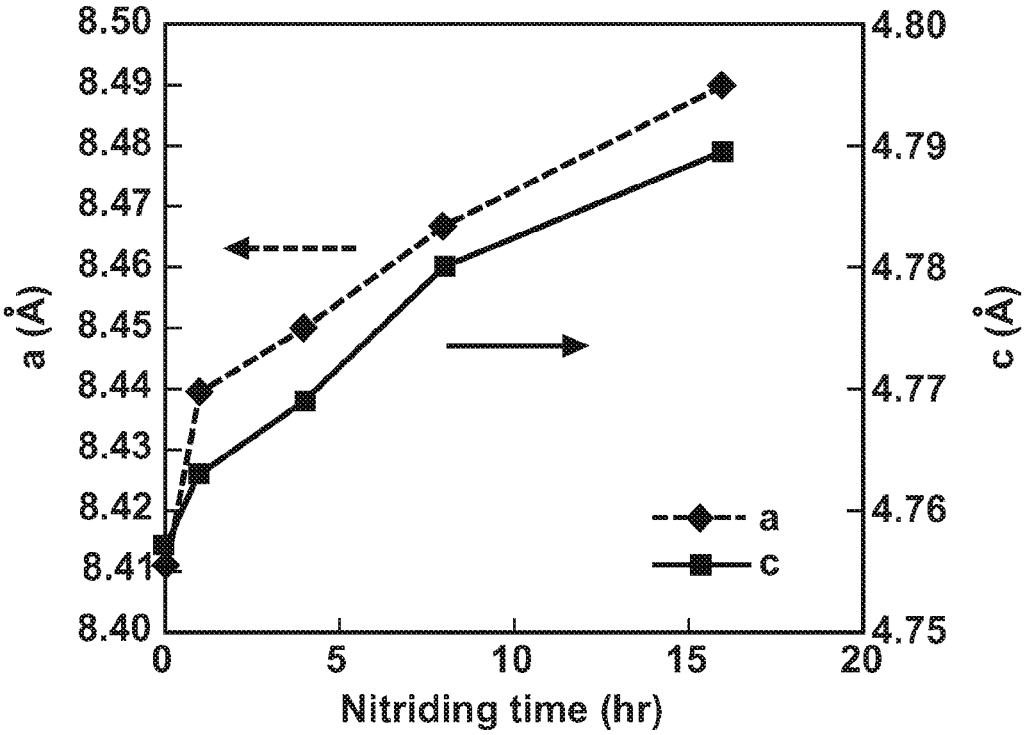
FIG. 5 (*a*) presents a graph of lattice expansion versus nitriding time in hours and FIG. 5(*b*) presents a graph of volume expansion versus nitriding time in hours after nitriding of a sample of $CeFe_{12}Si_2$ melt spun at $v_S$=15 m/s.
Figure 5B:
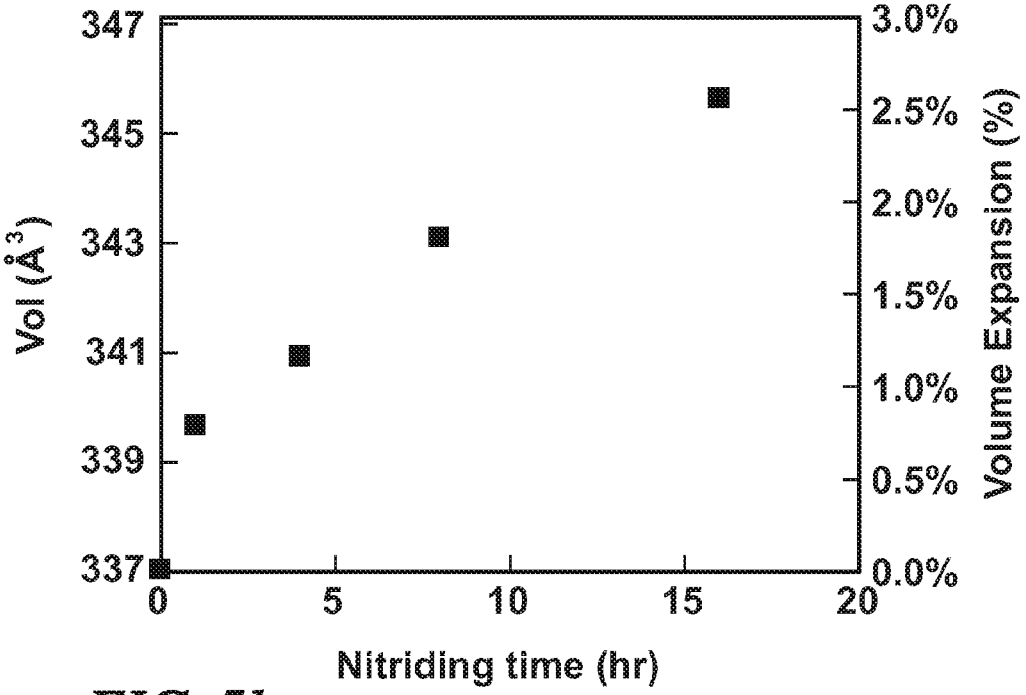

XRD examinations of the nitrides show that the $ThMn_{12}$ tetragonal crystal structure is retained, and that insertion of N atoms into the lattice results in an overall increase in the unit cell volume. Accompanying the lattice and volume expansions (shown in FIG. 5), $T_c$ increases substantially relative to the material before nitriding. For example, nitriding $CeFe_{10}Si_2$ to $CeFe_{10}Si_2N_{1.29}$ using 20 bar of nitrogen gas at 450° C. for 16 hours increases $T_c$ from 305° C. to 426° C. The latter value is noteworthy in that it is substantially larger than $T_c$=312° C. of $Nd_2Fe_{14}B$, and thus is a very promising material for further development as a permanent magnet. The higher $T_c$ value results in a smaller change in properties between room temperature and motor operating temperatures.

Previous literature reports on relevant $RFe_{12-x}M_x$ suggest that due to the atomic size difference, Ti and Si preferentially occupy different sites in the lattice. The DFT calculations performed on $CeFe_8Ti_4$ and $CeFe_8Si_4$ indicate that Ti preferentially occupies the 8i site in the 1-12 lattice, while the Si preferentially occupies the 8j site. The preferential substitution of Ti and Si at different sites suggests that a series of hypothetical quaternary compounds of the form $CeFe_{10+x}Si_{2-2x}Ti_x$ could result in lattice distortion different from a single element substitution scheme, which offers a new variable to tune the magnetic properties. The quaternary $CeFe_{10+x}Si_{2-2x}Ti_x$ could be perceived as a solid solution of ternary $CeFe_{10}Si_2$ and $CeFe_{11}Ti$.

Figure 6:
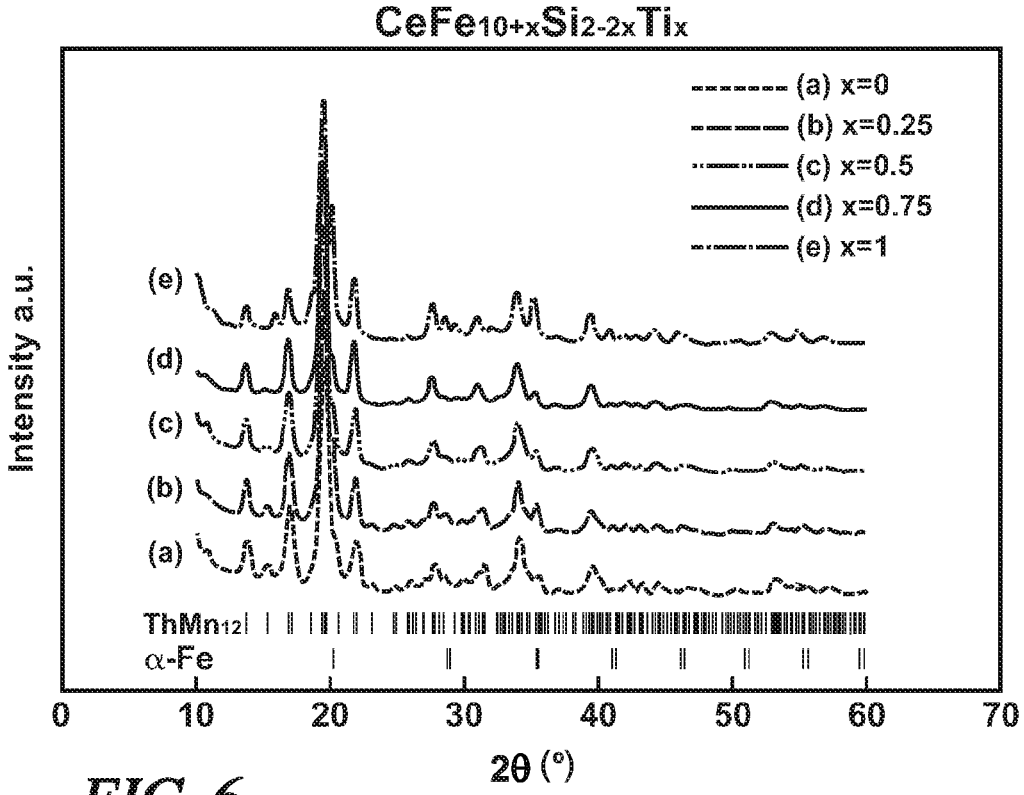
FIG. 6 is an X-ray diffraction pattern of melt spun $CeFe_{10+x}Si_{2-2x}Ti_x$, where x=0, 0.25, 0.5, 0.75, and 1. The as-spun samples typically consist of primary $ThMn_{12}$-type phase with minor Fe-based impurity phase (denoted as α-Fe in the figure).
Figure 7:
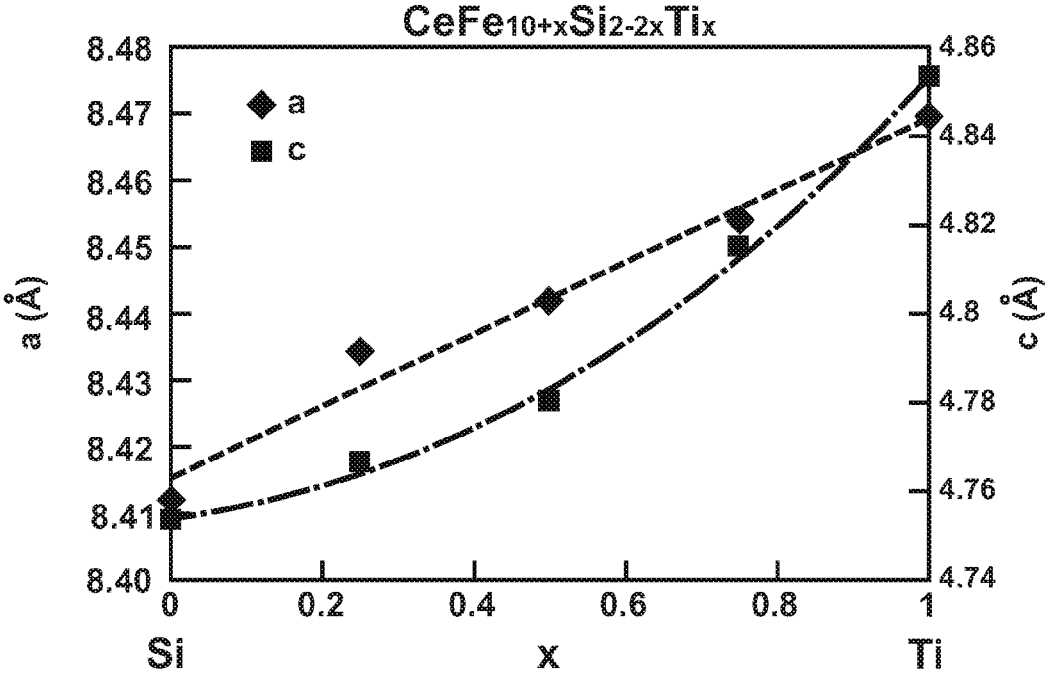
FIG. 7 is a graph of lattice constants of melt spun $CeFe_{10+x}Si_{2-2x}Ti_x$, where x=0, 0.25, 0.5, 0.75, and 1. The values of the lattice constants a in Å (filled diamonds) are on the left vertical axis and the values of the lattice constants c in Å (filled squares) are on the right vertical axis.

Alloys of $CeFe_{10}Si_2$, $CeFe_{10.25}Si_{1.5}Ti_{0.25}$, $CeFe_{10.5}Si_1Ti_{0.5}$, $CeFe_{10.75}Si_{0.5}Ti_{0.75}$, and $Ce_{1.1}Fe_{11}Ti$ were prepared by combining stoichiometric quantities of elemental Ce, Fe, Si, and Ti. Ingots were prepared by induction melting the elements under argon inert gas at 1375-1450° C., holding the molten alloy at that temperature for 3-5 minutes to insure complete homogenization by induction stirring. Pieces of the resulting homogenized ingot were placed in a quartz ampoule having a 0.65±0.01 mm diameter orifice in the bottom, re-melted by induction heating to 1380-1450° C., and melt spun by applying a 2.5-3.5 psi overpressure to eject the molten alloy onto the circumference of a rapidly rotating chromium-plated copper wheel (D=25.4 cm). The surface speed, $v_s$, of the wheel was varied between and 10 and 45 m/s to alter the quench conditions. The resulting ribbon materials were collected, ball milled into powder, and their properties examined by X-ray diffraction (XRD) to determine crystal structure and phase composition. FIG. 6 displays the x-ray diffraction patterns for $CeFe_{10+x}Si_{2-2x}Ti_x$ for x=0 (a), x=0.25 (b), x=0.5 (c), x=0.75 (d), and x=1 (e); where x=0 and x=1 represent the ternary compounds $CeFe_{10}Si_2$, and $CeFe_{11}Ti$ respectively. Note that the $CeFe_{11}Ti$ ingot in this example was prepared with ten atomic percent excess cerium content (i.e., $Ce_{1.1}Fe_{11}Ti$). It was found that the extra cerium was beneficial in promoting the formation of the 1:12 phase and in the retention of the 1:12 phase when they were nitrided. The as-spun samples consisted of a primary $ThMn_{12}$-type phase of the respective ternary or quaternary compound with a minor Fe-based impurity phase (identified as α-Fe in the figure). FIG. 7 displays the lattice constants (a) and (c) of the respective ternary and quaternary compounds as functions of x.

Figure 8:
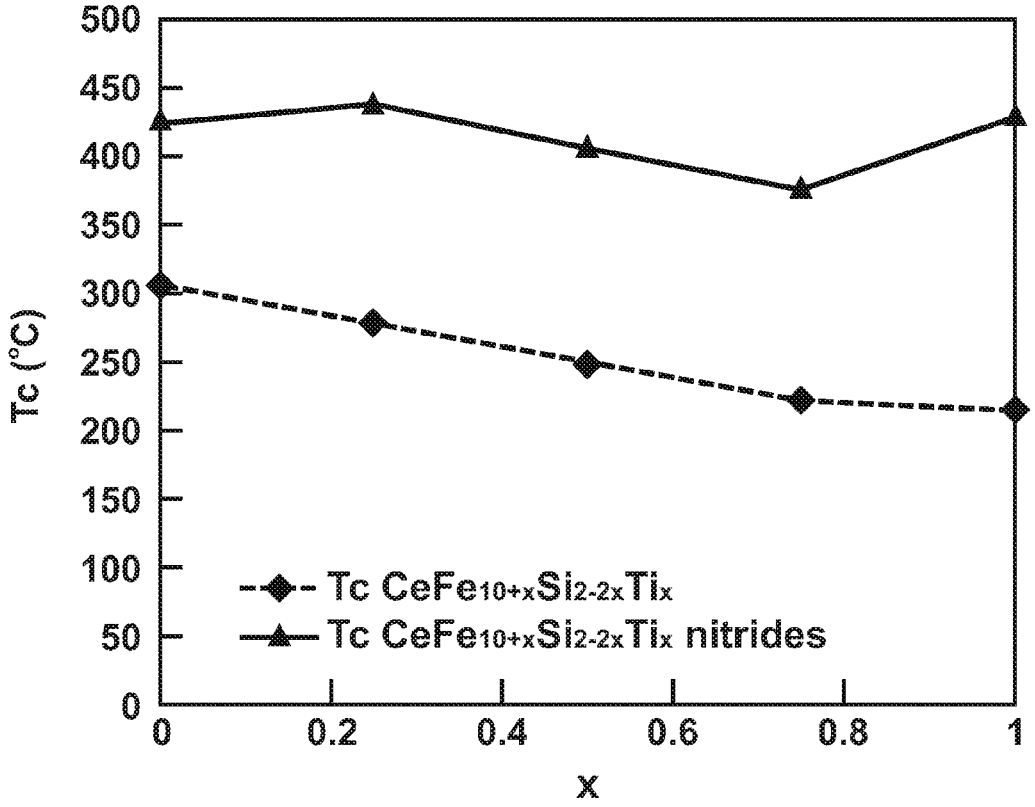
FIG. 8 is a graph of Curie temperatures $T_c$ of the base ternary and quaternary compounds (filled diamonds) of $CeFe_{10+x}Si_{2-2x}Ti_x$ (where x=0, 0.25, 0.5, 0.75, and 1), and their respective nitrides (filled triangles).

Nitriding of selected $CeFe_{10+x}Si_{2-2x}Ti_x$ ribbons was performed in a Hiden Isochema Intelligent Gravimetric Analyzer (IGA). The typical nitriding profile is set as the following: temperature (T) 450° C., time (t) 1-16 hours, and pressure (P) 20 bar. The powders were sieved to smaller than 45 μm sized particles prior to nitriding. The nitrogen uptake was calculated from the change in sample weight at approximately 1 bar and room temperature (20° C.) before and after nitrogenation, in order to eliminate the confounding effect of buoyant forces at elevated pressure and temperature. $CeFe_{10}Si_2$ exhibits the highest $T_c$=305° C. and $CeFe_{11}Ti$ has the lowest $T_c$=215° C.; the latter is in good agreement with the value of $T_c$=233° C. previously reported in the literature for $CeFe_{11}Ti$. The $T_c$ for the quaternary nitrides decreases monotonically with x. Curie temperatures are greatly increased after nitrogenation, with the smallest $\Delta T_c$=121° C. from $CeFe_{10}Si_2$ and the largest $\Delta T_c$=215° C. from $CeFe_{11}Ti$. Quaternary compounds of the form $CeFe_{10+x}Si_{2-2x}Ti_x$ with x=0.25, 0.5, and 0.75 exhibit a Curie temperature enhancement exceeding 150° C., a larger enhancement compared to ternary $CeFe_{10}Si_2$. Magnetic moment has also been increased in the nitrides with the smallest increase of 12.8% in $CeFe_{10.25}Si_{1.5}Ti_{0.25}$ and the largest increase of 20.6% in $CeFe_{10.75}Si_{0.5}Ti_{0.75}$. FIG. 8 displays the Curie temperature of the $CeFe_{10+x}Si_{2-2x}Ti_x$ compounds and their nitrides.

Table III summarizes the lattice constants, magnetic moment $4\pi M_s$, and Curie temperature for quaternary $CeFe_{10+x}Si_{2-2x}Ti_x$ and their nitrides. For the nitrides, the rightmost column also gives the number y of N atoms per $CeFe_{10+x}Si_{2-2x}Ti_xN_y$ formula unit as determined from measured nitrogen weight gain during nitriding. $CeFe_{10.25}Si_{1.5}Ti_{0.25}$ and $CeFe_{10.5}SiTi_{0.5}$ were melt spun at wheel speed $v_s$=15 m/s while $CeFe_{10.75}Si_{0.5}Ti_{0.75}$ was melt spun at $v_s$=10 m/s. Except for $CeFe_{11}Ti$, the nitrides listed in the table have been nitrided at nitrogen pressure of 20 bar at 450° C. for 16 hours. As stated above, the $CeFe_{11}Ti$ starting material listed in Table III was initially formed using 10 at % excess Ce in the starting composition in order to promote formation of the $ThMn_{12}$ phase in both the as-formed melt-spun products and the nitrided products. For $CeFe_{11}Ti$ the nitriding was completed at a reduced pressure and temperature of 10 bar at 410° C. for 18 hours.

TABLE III

| Nominal composition | Lattice constants a (Å) | Lattice constants c (Å) | Magnetic moment $4\pi M_s$ (Tesla) | $T_c$ (° C.) | N atoms y per f.u. |
|---|---|---|---|---|---|
| $CeFe_{10}Si_2$ | 8.411 | 4.757 | 1.04 | 305 | |
| $CeFe_{10.25}Si_{1.5}Ti_{0.25}$ | 8.434 | 4.766 | 1.09 | 278 | |
| $CeFe_{10.5}SiTi_{0.5}$ | 8.442 | 4.780 | 1.08 | 245 | |
| $CeFe_{10.75}Si_{0.5}Ti_{0.75}$ | 8.454 | 4.815 | 1.02 | 222 | |
| $CeFe_{11}Ti$ | 8.481 | 4.801 | 0.90 | 215 | |
| $CeFe_{10}Si_2N_y$ | 8.490 | 4.790 | 1.16 | 426 | 1.29 |
| $CeFe_{10.25}Si_{1.5}Ti_{0.25}N_y$ | 8.519 | 4.821 | 1.23 | 438 | 1.34 |
| $CeFe_{10.5}SiTi_{0.5}N_y$ | 8.545 | 4.880 | 1.27 | 406 | 1.87 |
| $CeFe_{10.75}Si_{0.5}Ti_{0.75}N_y$ | 8.570 | 5.008 | 1.23 | 375 | 2.72 |
| $CeFe_{11}TiN_y$ | 8.590 | 4.898 | 1.21 | 430 | 2.40 |

Thus, we have described a new family of permanent magnet materials that contain a major weight proportion of one or more compounds of $CeFe_{12-x}M_x$, having the $ThMn_{12}$ crystal structure (space group I4/mmm, #139) and with M being one or more of the elements B, Al, Si, P, S, Sc, Co, Ni, Zn, Ga, Ge, Zr, Nb, Hf, Ta, and W. Preferably, x is in the range of one to four. In addition, one or more of Ti, V, Cr, and Mo may be combined with, or substituted for, up to about ninety atomic percent of an M element in the $CeFe_{12-x}M_x$ compound.

The material may be prepared from a melt of the constituent elements by rapid solidification to form with a major portion of the $CeFe_{12-x}M_x$ compound. The material may be prepared in the form of a powder or other form for shaping and consolidating into a permanent magnet body for an electric motor or other desired product application. And the permanent magnet material may be nitrided to increase its Curie temperature and its permanent magnet properties.

Practices of the invention have been illustrated by specific examples which are not intended to limit the scope of the invention.

The invention claimed is:

1. A permanent magnet material containing the compound, $Ce(Fe_{12-x}Si_x)$, having the tetragonal $ThMn_{12}$ crystal structure, space group I4/mmm, #139 and where x has a value in the range of one to four, the compound $Ce(Fe_{12-x}Si_x)$, having been prepared from a melt consisting of cerium, iron, and silicon and the melt having been rapidly solidified at a cooling rate to form particles of a permanent magnet material containing the compound having the tetragonal $ThMn_{12}$ crystal structure, space group I4/mmm, #139, the particles of permanent magnet material having a magnetic moment value, $4\pi Ms$, in the range of 1.04 to 1.27 Tesla, the $Ce(Fe_{12-x}Si_x)$ compound contains one or more of Ti, V, Cr, and Mo in combination with Si such that the combination provides a value of x in the range of 1-4 and Si comprises at least 0.1 x.

2. A permanent magnet material as stated in claim 1 and containing at least seventy percent by weight of the $Ce(Fe_{12-x}Si_x)$ compound.

3. A permanent magnet material containing the compound, $Ce(Fe_{12-x}Si_x)$, having the tetragonal $ThMn_{12}$ crystal structure, space group I4/mmm, #139 and where x has a value in the range of one to four, the compound $Ce(Fe_{12-x}Si_x)$, having been prepared from a melt consisting of cerium, iron, and silicon and the melt having been rapidly solidified at a cooling rate to form particles of a permanent magnet material containing the compound having the tetragonal $ThMn_{12}$ crystal structure, space group I4/mmm, #139, the particles of permanent magnet material having a magnetic moment value, $4\pi Ms$, in the range of 1.04 to 1.27 Tesla, the $Ce(Fe_{12-x}Si_x)$ compound containing nitrogen, $Ce(Fe_{12-x}Si_x)N_y$, the value of y being from one to three such that the nitrogen is present in an amount up to three nitrogen atoms per formula unit for increasing the Curie temperature, $T_c$, of the material as compared with the $T_c$ of the same $Ce(Fe_{12-x}Si_x)$ compound without the nitrogen.

4. A permanent magnet material as stated in claim 3 and containing at least seventy percent by weight of the crystalline $Ce(Fe_{12-x}Si_x)N_y$ compound.

5. A permanent magnet material as stated in claim 1 in which the $Ce(Fe_{12-x}Si_x)$ compound further containing nitrogen in an amount up to three nitrogen atoms per formula unit, the nitrogen being present in an amount for increasing the Curie temperature, $T_c$, of the material as compared with the $T_c$ of the same $Ce(Fe_{12-x}Si_x)$ compound without the nitrogen.

6. A permanent magnet material as stated in claim 2 in the form of a consolidated particle permanent magnet.

7. A permanent magnet material as stated in claim 4 in the form of a consolidated particle permanent magnet.

8. A permanent magnet material as stated in claim 5 in the form of a consolidated particle permanent magnet.

* * * * *